United States Patent [19]

Barouh et al.

[11] 3,974,539

[45] Aug. 17, 1976

[54] CUTTER DEVICE FOR TYPEWRITER CORRECTION PICK-OFF DEVICE

[76] Inventors: Victor Barouh, 935 Plum Tree Road West, Westbury, N.Y. 11590; Robert Glenn, 400 E. 56 St., New York, N.Y. 10022

[22] Filed: Jan. 8, 1975

[21] Appl. No.: 539,336

[52] U.S. Cl. ..... 15/104 R; 3/115; 197/181; 294/1 R

[51] Int. Cl.[2] ..... B41J 29/26; B43L 19/00

[58] Field of Search ..... 15/104 A, 210 R, 219; 30/115, 124, 128, 129; 294/1 R, 1 CA; 401/50

[56] References Cited

UNITED STATES PATENTS

| | | | |
|---|---|---|---|
| 1,482,300 | 1/1924 | Hansen | 401/50 |
| 2,335,623 | 11/1943 | Utterback | 15/219 |
| 2,492,492 | 12/1949 | McCreary | 401/50 |
| 2,580,864 | 1/1952 | Upright | 30/115 X |
| 2,736,911 | 3/1956 | Larsen | 15/210 R |
| 2,813,336 | 11/1957 | Ackerman | 30/115 |
| 3,397,027 | 8/1968 | Harrison | 401/50 |
| 3,797,875 | 3/1974 | Hamer | 294/1 R |

FOREIGN PATENTS OR APPLICATIONS

| | | | |
|---|---|---|---|
| 341,432 | 11/1959 | Switzerland | 401/50 |

*Primary Examiner*—Daniel Blum
*Attorney, Agent, or Firm*—Kenneth S. Goldfarb

[57] ABSTRACT

A correction device for typewritten material for correcting type errors when using typewriter ribbons having a non-absorbent, non-penetrating, non-wetting ink. The device includes a wax pick-off rod mounted for advancement and retracted in a casing. A resiliently mounted cutting blade is provided for cutting a flat end on the rod to facilitate pick-off of an incorrectly typed character and for again providing a clean pick-off surface by cutting a fresh flat end after use.

5 Claims, 9 Drawing Figures

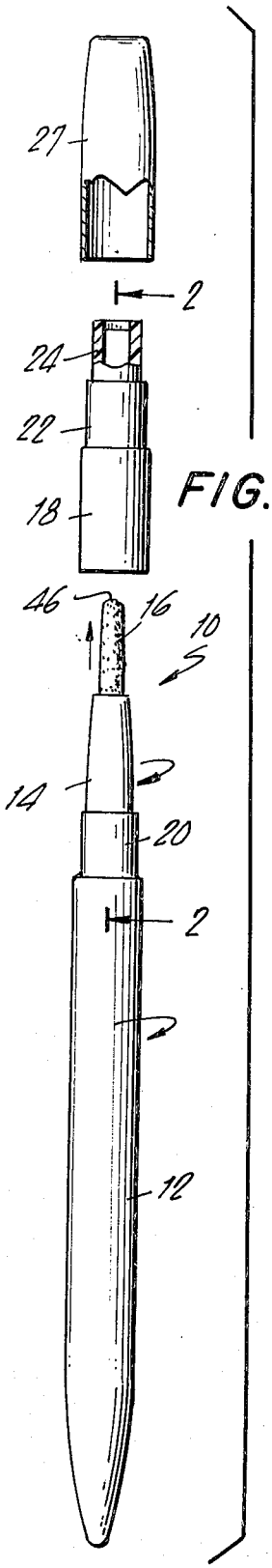
FIG. 1
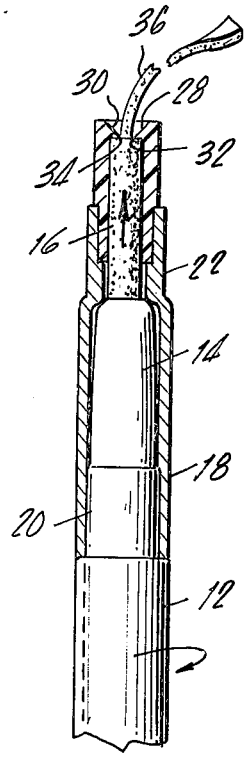
FIG. 2
FIG. 3
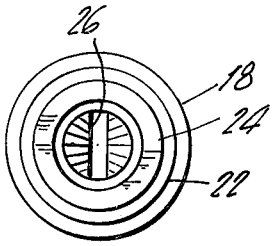
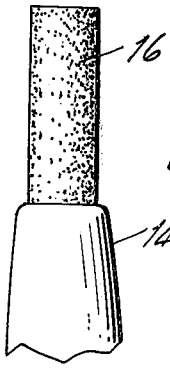
FIG. 4
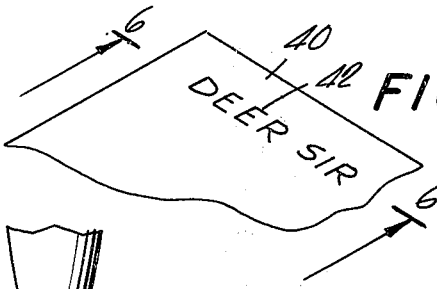
FIG. 5
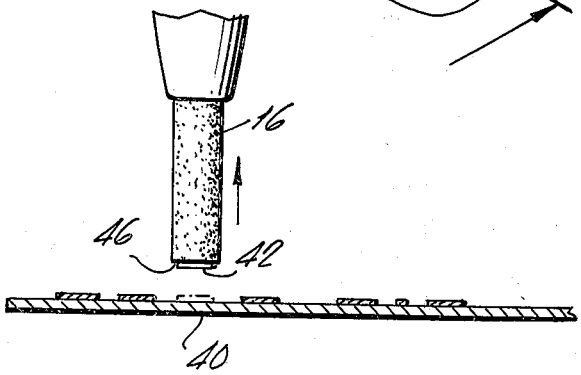
FIG. 6

FIG. 7
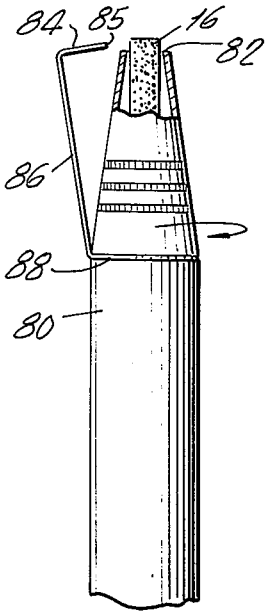
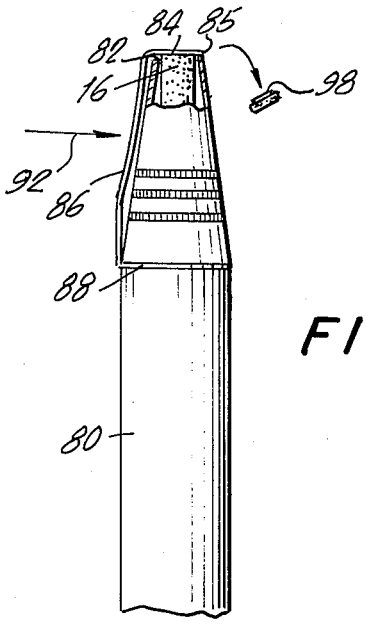
FIG. 9
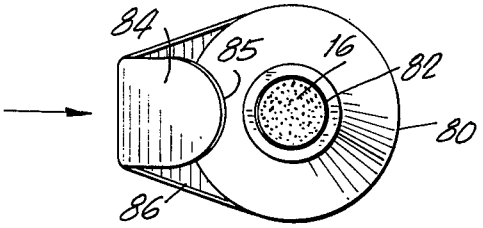
FIG. 8

CUTTER DEVICE FOR TYPEWRITER CORRECTION PICK-OFF DEVICE

BACKGROUND OF THE INVENTION

1. Field of the Invention

This invention relates to a correction device for typewritten material having a resiliently mounted cutting device and is especially adapted for use in conjunction with typewriter ribbons of the type that are coated with a non-absorbent carbon material which does not wet the paper onto which it is type-written.

2. Description of the Prior Art

Various types of typewriter ribbons have been devised in the past which are manufactured out of various non-absorbent ink compositions of transfer materials which do not wet or dye the paper onto which the characters are typed. These transfer materials are generally of a relatively dry wax composition and may have one or more coatings for preventing penetration of the transfer material into the paper.

In the past, correction ribbons for typewriters employing adhesives or an ink correction material have been used such as shown in U.S. Pat. No. 3,141,539. However, in correcting errors made by a typewriter using non-absorbent, nonpenetrating, non-wetting ink, it is preferable that the erroneous typewritten character be completely removed, rather than coating the erroneous character with correction material and then striking a correct character thereover. An adhesive ribbon has been used in the past but this requires careful matching of the error and identification of the error before removal of the typewritten material from the typewriter.

In our copending application Ser. No. 418,423, now U.S. Pat. No. 3,889,310, issued June 17, 1975, for Typewritten Correction Device Employing an Adhesive Ribbon, a device employing an adhesive ribbon movable on rollers is disclosed. While this device is successful in operation, it is somewhat more complex in construction when compared to the present invention.

SUMMARY OF THE INVENTION

This invention concerns a device for correcting typewritten errors removing completely from the paper a typed impression and leaving paper completely clean, thus permitting typing the correct or desired character or characters in the space where the error was previously made. This differs from the other devices for correcting typewritten errors where the error is covered by a white opaquing ink and the correct or desired character or characters are typed on top of this white opaquing ink.

The typewritten material which is to be corrected is of a special ink consisting of resin, pigments, plasticizer in a solvent or a special ink consisting of wax, oil, pigment, dye and resin in a hot melt formulation is formulated and coated on a film substrate. Films such as polyethylene, Mylar, Nylon, acetate are used as the substrates for the inks.

The special inked ribbon described can be corrected using a sticky composition. This sticky wax composition can be molded in the shape of a rod or a stick and as such is inserted into a casing with a mechanism similar to the mechanism of a lead pencil, that is similar to the screwing out of a fresh lead point as the lead is used. In this invention there is, however, a novel resiliently mounted blade providing a cutting edge. When the present invention is employed to make a correction, the ink that is removed from the paper will naturally remain on the end of the sticky wax composition and another correction with the same wax end cannot be easily made. The device is constructed in such a way that the cutting blade can be actuated so as to cut the used flat end and expose a fresh, clean flat end ready to make the next correction. Additionally, the invention conceives of a wax with hardness to form a rod-like shape and to have tack-like feel for pick-off.

It is an object of the present invention to provide an easily manipulated hand operated device provided with a novel cutting device for use in correcting typewritten errors that is simple in construction and capable of being inexpensively manufactured out of readily available materials.

These, together with various ancillary objects and features of the invention which will become apparent as the following description proceeds are attained by the correction device, and wax formulation therefore, a preferred embodiment of which is illustrated in the accompanying drawing, by way of example only, wherein:

BRIEF DESCRIPTION OF THE DRAWING

FIG. 1 is an exploded elevational view of a correction device;

FIG. 2 is a partial longitudinal sectional view taken along the plane of line 2—2 in FIG. 1;

FIG. 3 is a top plane view in an enlarged scale of the correction device;

FIG. 4 is a partial enlarged elevational view of the wax rod end of the correction device;

FIG. 5 is a perspective view illustrating an error to be corrected;

FIG. 6 is a vertical sectional view taken along the plane of line 6—6 in FIG. 5, illustrating the manner in which an error is corrected utilizing the present invention;

FIG. 7 is a partial elevational view with parts broken away of another embodiment and the preferred form of the invention;

FIG. 8 is a view showing the manner of use of the invention of FIG. 7; and FIG. 9 is a top plan view of the preferred embodiment.

DETAILED DESCRIPTION OF THE INVENTION

With continuing reference to the accompanying drawing wherein like reference numerals designate similar parts throughout the various views, reference numeral 10 designates a correction device constructed in accordance with the concepts of the present invention. This correction device includes a casing 12 having a barrel rotatably mounted therein in a conventional manner together with a mechanism, not shown, for advancing and withdrawing a pick-off rod 16.

A tubular end piece 18 is removably seated on the stepped portion 20 of the casing 12. The end piece 18 is itself stepped at 22 and has an end portion 24 which is just slightly larger than the diameter of the wax rod 16 so as to closely guide and support the wax rod. The outermost end is provided with a slit 26 provided with tapered sides 28, 30 forming knife edges 32 and 34 extending normal to the rod 16 so that the wax rod is advanced by rotating the casing 12 while holding the end piece 18 and hence the barrel 14 stationary, the cutting edges 32 and/or 34 will cut the end of the wax rod as at 36. A cap 27 is provided for fitting over the stepped portion 22.

The wax rod 16 is of a relatively hard, yet tacky substance. It may be colored or transparent as desired, it being noted that the employment of a light transmitting wax rod will facilitate the use thereof in accurately positioning the rod. An example of the formulation of the wax rod is as follows:

Example I

| | |
|---|---|
| Paraffin wax | 40 parts |
| Plastic microcrystalline petroleum wax | 60 parts |
| | 100 parts |

The correction device is used to remove incorrect characters typed on a substrate 40. When an incorrect symbol 42 is typed on the substrate 40, even when in the typewriter, the typist can apply the end of the wax pick-off rod 16 to the character 42 which adheres thereto and is thus removed from the substrate 40. The end piece 18 can then be inserted over the barrel 14 and the rod 16 rotated relative to the cutting edges 32 and 34 so as to cut the used flat end 46 and expose a fresh clean flat end 46 ready to make the next correction. In FIG. 7, the preferred embodiment as illustrated includes a barrel 80 in which the stick of wax-like material 16 is mounted for feeding through the end opening 82. A cutter blade 84 having a semicircular cutting edge 85 is resiliently mounted by means of leaf spring section 86 and mounting ring 88 on the barrel 80, the ring 88 providing for rotation of blade 84 as desired.

By merely pressing on the blade 64 or spring section 86, in the direction of the arrow, the blade will cut off the used end carrying the erroneous character 98 thereon as shown in FIG. 9.

A latitude of modification, substitution, and change is intended in the foregoing disclosure, and in some instances, some features of the present invention may be employed without a corresponding use of other features.

We claim:

1. A correction device for typewritten material comprising a casing, a barrel rotatable in said casing, a tack wax pick-off rod mounted in said barrel for advancement and retraction relative thereto, and a cutting blade mounted on said barrel and extending normal to said rod for cutting a flat end on said rod, said cutting blade being integral with a leaf spring section and a ring being integral with said leaf spring section, said ring being secured to said barrel.

2. A correction device according to claim 1, wherein said ring is rotatably mounted on said barrel, said blade having a semicircular cutting edge.

3. A correction device according to claim 2, wherein said rod is cylindrical in shape.

4. A correction device according to claim 3, wherein said rod is composed of 40 parts paraffin wax and 60 parts plastic microcrystalline petroleum wax.

5. A correction device according to claim 4 wherein said rod is light transmitting.

* * * * *